US006467294B1

(12) United States Patent
Walker et al.

(10) Patent No.: US 6,467,294 B1
(45) Date of Patent: Oct. 22, 2002

(54) APPARATUS AND METHOD FOR CONTROLLING TEMPERATURE FOR A SELF-SERVICE FOOD DISPLAY

(75) Inventors: Darrel Jay Walker, Mt. Pleasant, MI (US); Kenneth James Houtman, Mt. Pleasant, MI (US); Scott Alan McNeal, Shepherd, MI (US)

(73) Assignee: The Delfield Company, Mt. Pleasant, MI (US)

( * ) Notice: Subject to any disclaimer, the term of this patent is extended or adjusted under 35 U.S.C. 154(b) by 0 days.

(21) Appl. No.: 09/849,509

(22) Filed: May 4, 2001

(51) Int. Cl.[7] ..... A47F 3/04
(52) U.S. Cl. ..... 62/255; 62/256
(58) Field of Search ..... 62/255, 256, 246

(56) References Cited

U.S. PATENT DOCUMENTS

| | | | | |
|---|---|---|---|---|
| 2,967,404 A | | 1/1961 | Detwiler | 62/256 |
| 3,543,532 A | | 12/1970 | Gatton et al. | 62/256 |
| 4,106,305 A | | 8/1978 | Ibrahim | 62/89 |
| 4,295,340 A | | 10/1981 | Abraham | 62/82 |
| 4,329,852 A | | 5/1982 | Ibrahim et al. | 62/256 |
| 4,592,209 A | | 6/1986 | Casanova et al. | 62/255 |
| 4,651,536 A | * | 3/1987 | Nax | 62/256 |
| 4,750,335 A | * | 6/1988 | Wallace et al. | 62/256 |
| 4,777,806 A | * | 10/1988 | Perez | 62/256 |
| 5,168,719 A | * | 12/1992 | Branz et al. | 62/256 |
| 5,477,702 A | * | 12/1995 | Kennedy et al. | |
| 6,089,036 A | * | 7/2000 | Carlson et al. | 62/256 |

* cited by examiner

*Primary Examiner*—William E. Tapolcai
*Assistant Examiner*—Mohammad M. Ali
(74) *Attorney, Agent, or Firm*—Ohlandt, Greeley, Ruggiero & Perle, LLP

(57) ABSTRACT

A self-service food display in which a food tray that is supported by a support structure is cooled by an air stream that passes over and under the tray. The tray has opposed end sections and one or more intermediate sections. The air stream is uniformly distributed over the intermediate sections to substantially maintain the same temperature in the vicinity thereof. The air stream is distributed to the opposed end sections in higher volumes to minimize heat transfer with ambient. The air stream also forms an air curtain that extends above three sides of the food tray. Additionally, the air stream is distributed at an angle to an upper surface of the food tray in a manner that provides higher volumes to the opposed end sections to minimize heat transfer.

10 Claims, 7 Drawing Sheets

APPARATUS AND METHOD FOR CONTROLLING TEMPERATURE FOR A SELF-SERVICE FOOD DISPLAY

FIELD OF THE INVENTION

This invention relates to a self-service food display for the presentation of food items, for example, a salad bar.

BACKGROUND OF THE INVENTION

Self-service food displays that present food items to diners need to maintain the food items at an appropriate serving temperature. Thus, the self-service display needs to maintain a cool environment for the case of salad items or other items that need refrigeration. One type of prior art self-service food display provides a cool environment by disposing the food items in containers on a layer of ice. This has the disadvantages of too much cooling, i.e., freezing, and of disposal of melted water.

Another type of refrigerated display counter is shown in U.S. Pat. No. 4,592,209. This display counter has a tray upon which the food is displayed. A cooling air stream is circulated over the food in a direction generally parallel to the tray via a ductwork that extends along the front, under and back sides of the tray. A glass window is provided at the customer or front side of the display case. This display counter has the disadvantage that the diner must lift the glass window to pick up a food item. Also, the display counter is subject to non-uniform temperatures across the length of the salad bar due to heat transfer leakage.

Refrigerated food display cases for food shopping applications typically have a tank in which the food is disposed. A food shopper must reach down into the tank to get a food item. A cooled air stream is circulated over the top of the tank and through a ductwork that extends along the front, under and back sides of the tank. A blower mechanism and a refrigerated evaporator are usually disposed in the ductwork. Refrigerated food display cases of this type are disclosed in U.S. Pat. Nos. 2,967,404, 3,543,532, 4,106,305, 4,295,340 and 4,329, 852.

Thus, there is a need for a self-service display that maintains a uniform temperature for the displayed food items.

There is also a need for a method of maintaining a uniform temperature for the displayed food items.

SUMMARY OF THE INVENTION

A self-service food display according to the present invention includes food tray that is supported by a support structure. A ductwork is positioned with respect to the food tray to provide a cooling air stream over and under the food tray. The ductwork includes a plurality of ports arranged to distribute first volumes of the cooling air stream over and under one or more intermediate sections of the food tray to maintain a substantially uniform temperature thereof. The arrangement of ports is also such as to distribute second volumes of the cooling air stream over and under opposed end sections of the food tray. Each of the second volumes is larger than any of the first volumes so as to minimize heat transfer to ambient.

According to another aspect of the self-service food display of the invention, the first and second volumes of the cooling air stream flow are substantially parallel to the food tray. The ports are further positioned to distribute third volumes and fourth volumes of the cooling air stream at an angle to an upper surface of the intermediate and opposed end sections. Each of said fourth volumes is larger than any of said third volumes so as to minimize heat transfer to ambient.

According to another aspect of the self-service food display of the invention, the plurality of ports is further positioned to distribute the cooling air stream in the form of air curtains extending above three sides of the food tray.

An alternate embodiment of the self-service food display of the present invention includes a support structure having a base, a back and a top. A food tray having a front end, a back end and opposed side ends is supported by the support structure so as to be exposed to ambient on the front end and the opposed side ends. A ductwork extends beneath the food tray, up the back and across the top of the support structure. A plurality of air curtain ports is arranged in the ductwork for the formation of a front air curtain and one or more opposed side air curtains. At least one of the air curtain ports is disposed along a front of the top. At least a second one of the air curtain ports is disposed along one of opposed sides of the top. At least a third one of the air curtain ports is disposed along the front end and the opposed side ends of the tray.

According to another aspect of the alternate embodiment, the ductwork is in fluid communication with a passageway directly under the tray so as to provide a first airflow path for the cool air stream to cool the underside of the tray. According to still another aspect of the alternate embodiment, a plurality of ports is disposed in fluid communication with the ductwork in a location to provide a second airflow path substantially parallel to and across an upper surface of the tray.

According to a further aspect of the alternate embodiment, an array of ports is disposed at a location in the ductwork to provide a uniform distribution of air flow in a third path that is incident to an upper surface of the food tray at an acute angle to provide a uniform temperature throughout the third path in the vicinity of the tray.

According to a still further aspect of the alternate embodiment, the food tray has two opposed side sections and one or more intermediate sections. A first volume of the cool air stream is uniformly distributed under the intermediate sections and larger volumes of the cool air stream are distributed under any of the opposed sections that are exposed to ambient to minimize heat transfer.

The method of the present invention cools a food tray of a self-service food display. The food tray has a pair of opposed end sections and one or more intermediate sections. The method provides a cooling air stream. The cooling air stream is flowed over and under the intermediate sections in a manner to provide a substantially uniform temperature in the vicinity of the food tray. The cooling air stream is also flowed over and under the opposed end sections in a manner to minimize heat transfer to ambient.

According to an aspect of the method of the invention, also flows the cooling air stream in a manner to provide an air curtain that extends above three sides of the food tray. According to another aspect of the method, the cooling air stream is also flowed at an acute angle to an upper surface of the food tray in a manner that provides uniform volumes of the cooling air stream to the intermediate sections. This flow also provides higher volumes of the cooling air stream to the opposed end sections to minimize heat transfer to ambient.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
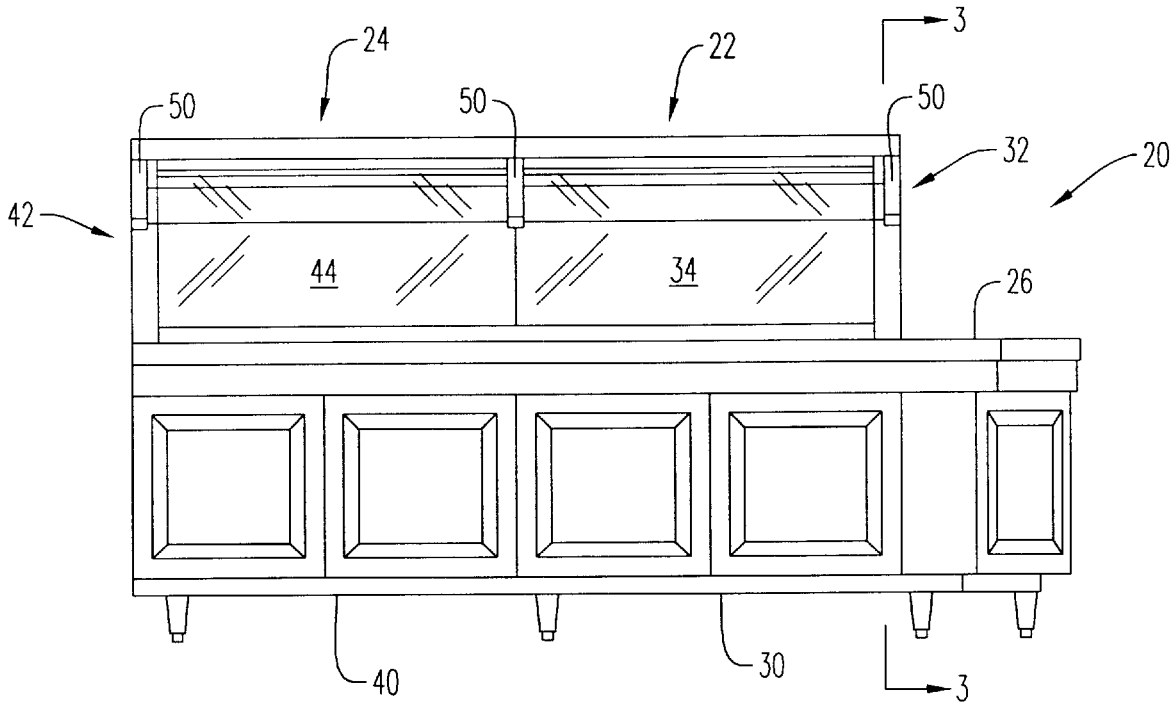
FIG. 1 is a front view of the self-service display of the present invention.
Figure 2:
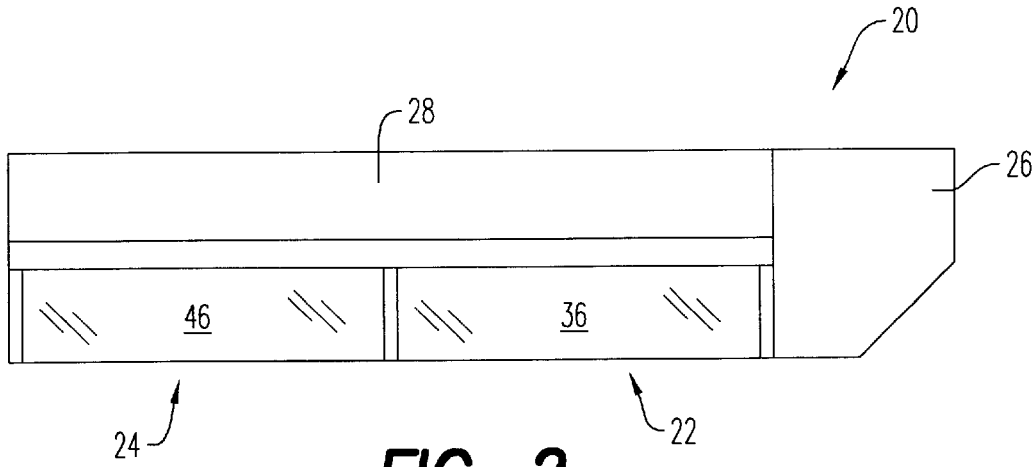
FIG. 2 is a top view of FIG. 1.
Figure 3:
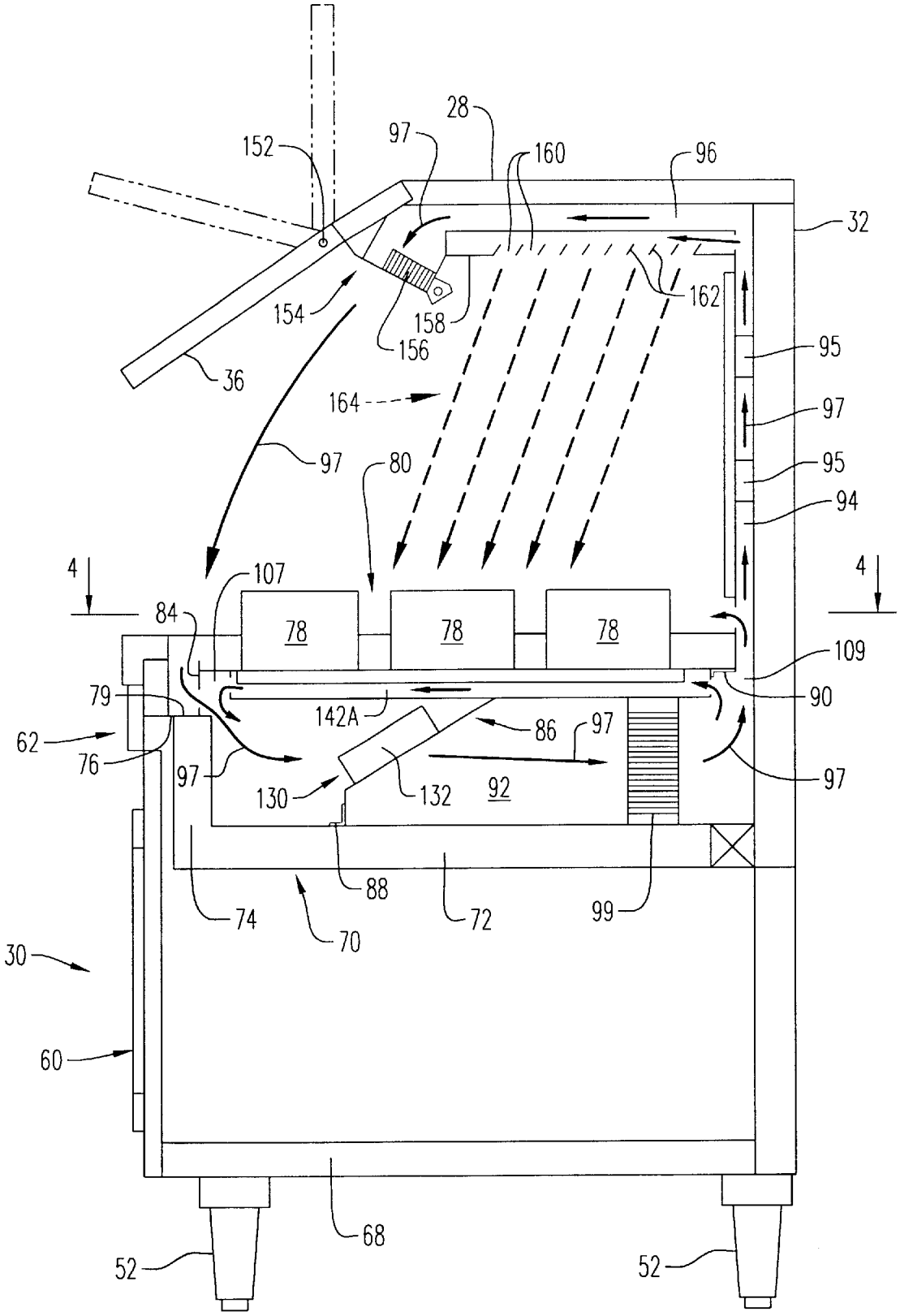
FIG. 3 is an enlarged view taken along line 3—3 of FIG. 1.
Figure 6:
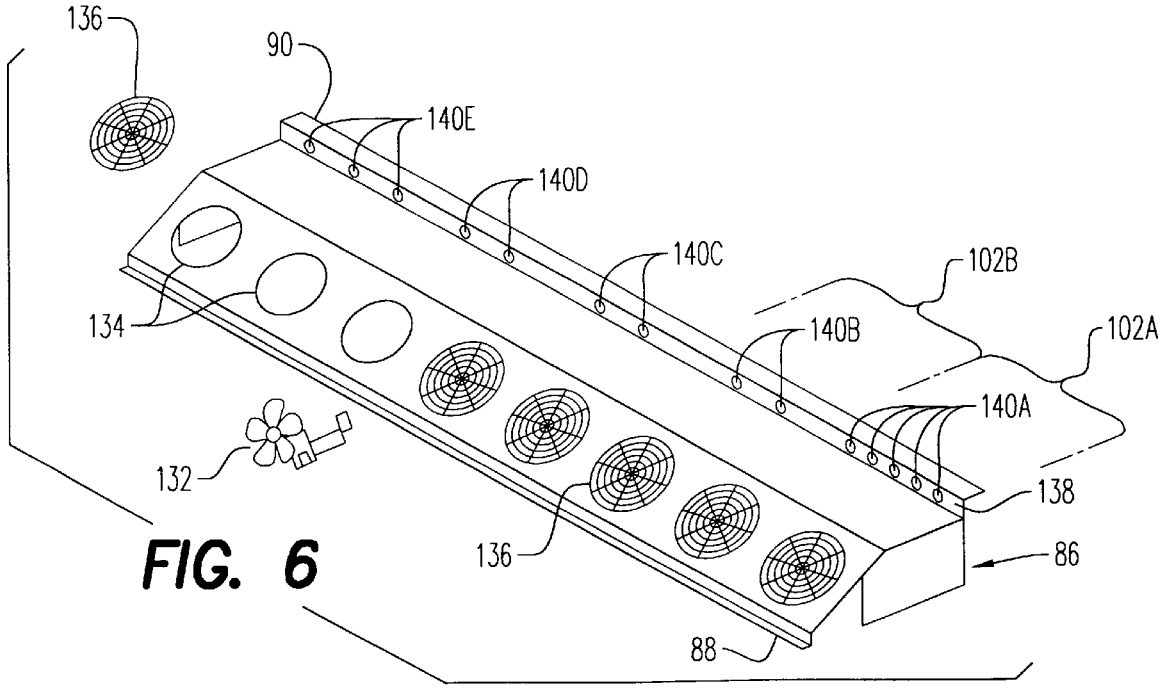
FIG. 6 is a perspective view of the blower assembly of the self-service food display of FIG. 1.

Referring to FIGS. 3 and 6, a blower assembly 130 includes bracket 86 to which fans 132 are mounted. Bracket 86 includes a plurality of apertures 134. Fans 132 are mounted on one side of the bracket 86 in registry with apertures 134. A plurality of filter covers 136 are mounted in registry with apertures 134. Bracket 138 includes a vertical portion 138 that forms a back of food tray assembly 80 between bottom assembly 114 and top assembly 100. A plurality of apertures 140A–140E are disposed in vertical portion 138.

Display stand 22 includes a base 30 and a back 32, which extends upwardly from base 30. A mirror 34 is disposed on back 30 and a transparent shield 36 is disposed in hinged relationship to top 28. Shield 36 may be clear glass or plastic. Display stand 24 includes a base 40 and a back 42, which extends upwardly from base 40. A mirror 44 is disposed on back 40 and a transparent shield 46 is disposed in hinged relationship to top 28.

A plurality of lights 50 is disposed just below top panel 28 to provide lighting for the self-service display 20. A plurality of legs 52 are attached to bases 30 and 40 and side counter 26.

Figure 4:
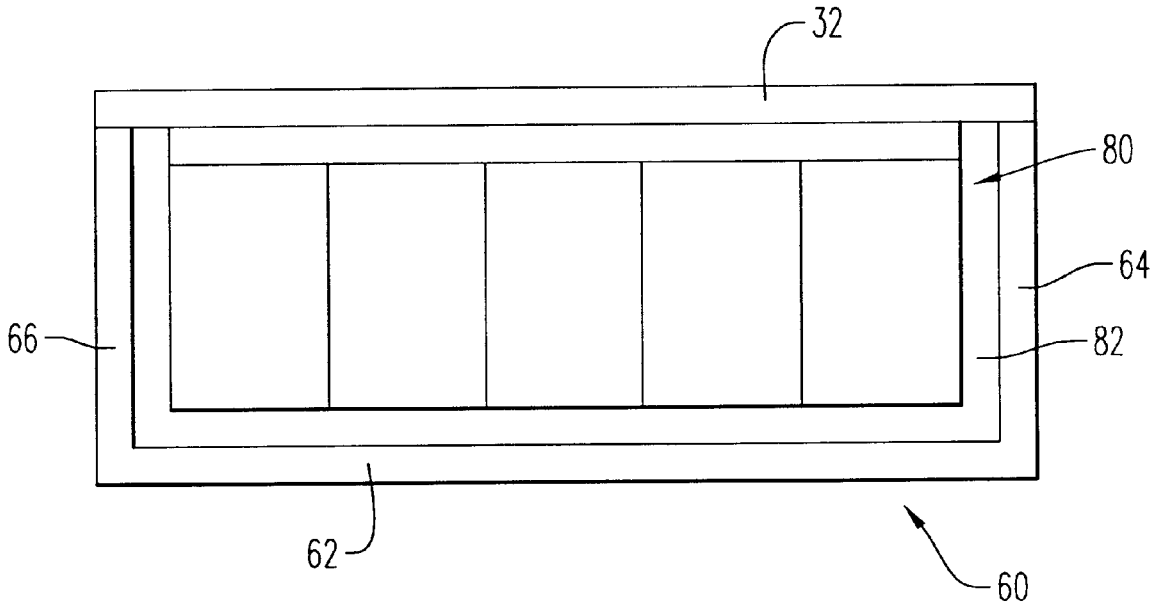
FIG. 4 is a view taken along line 4—4 of FIG. 3.

Referring to FIGS. 3 and 4, display stand 30 further includes a box frame 60. Box frame 60 has a front side 62, a right side 64, a left side 66 and a bottom 68. Right and left sides 64 and 66 and bottom 68 are attached to back 32 by any suitable means, such as brackets (not shown). A box 70 has a bottom 72 and a front 74 formed of an integral L-shaped member, but could be separate pieces that are joined together. Box 70 is positioned in the upper part of base 30 and supported to box frame 60 by one or more brackets 76 and to back 32 by any suitable means, such as brackets (not shown).

A plurality of food items 78 are located on a food tray assembly 80, which is disposed above box 70. Food tray assembly 80 is dimensioned and positioned to form a gap 82 with front side 62, right side 64 and left side 66 of box frame 60. Food tray assembly 80 has a front panel 84 that rests on a top 71 of box 70. A bracket 86 also supports food tray assembly 80. Bracket 86 extends upwardly from bottom 72 of box 70. Bracket 86 has a first end 88 attached to bottom 72 and a second end 90 attached to a bottom surface of food tray assembly 80.

Self-service food display 20 includes passageways 92, 94 and 96 that form ductwork for circulating an air stream to maintain food items 78 cooled. Box 70, back 32 and the bottom of food tray assembly 80 form passageway 92. A plurality of fans 132 and an evaporator coil 99 are disposed in passageway 92. Evaporator coil 99 is cooled by a refrigerant that is circulated therethrough by means not shown. Passageway 94 is formed by back 32 and the back of mirror 34, which is held in spaced relation to back 32 by a plurality of spacers 95. Passageway 96 is mounted to top 28 and/or back 32. Fans 132 operate to circulate an air stream in a path that includes passageways 92, 94 and 96 as shown by arrows 97. The circulating air stream is cooled by evaporator coil 99.

Figure 5A:
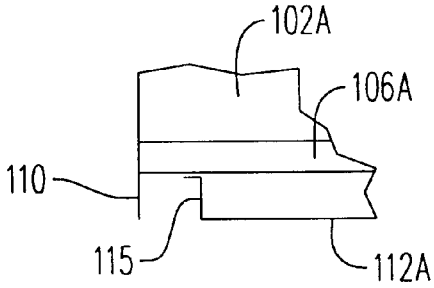
FIG. 5A is a view taken along line 5A—5A of FIG. 5.
Figure 5:
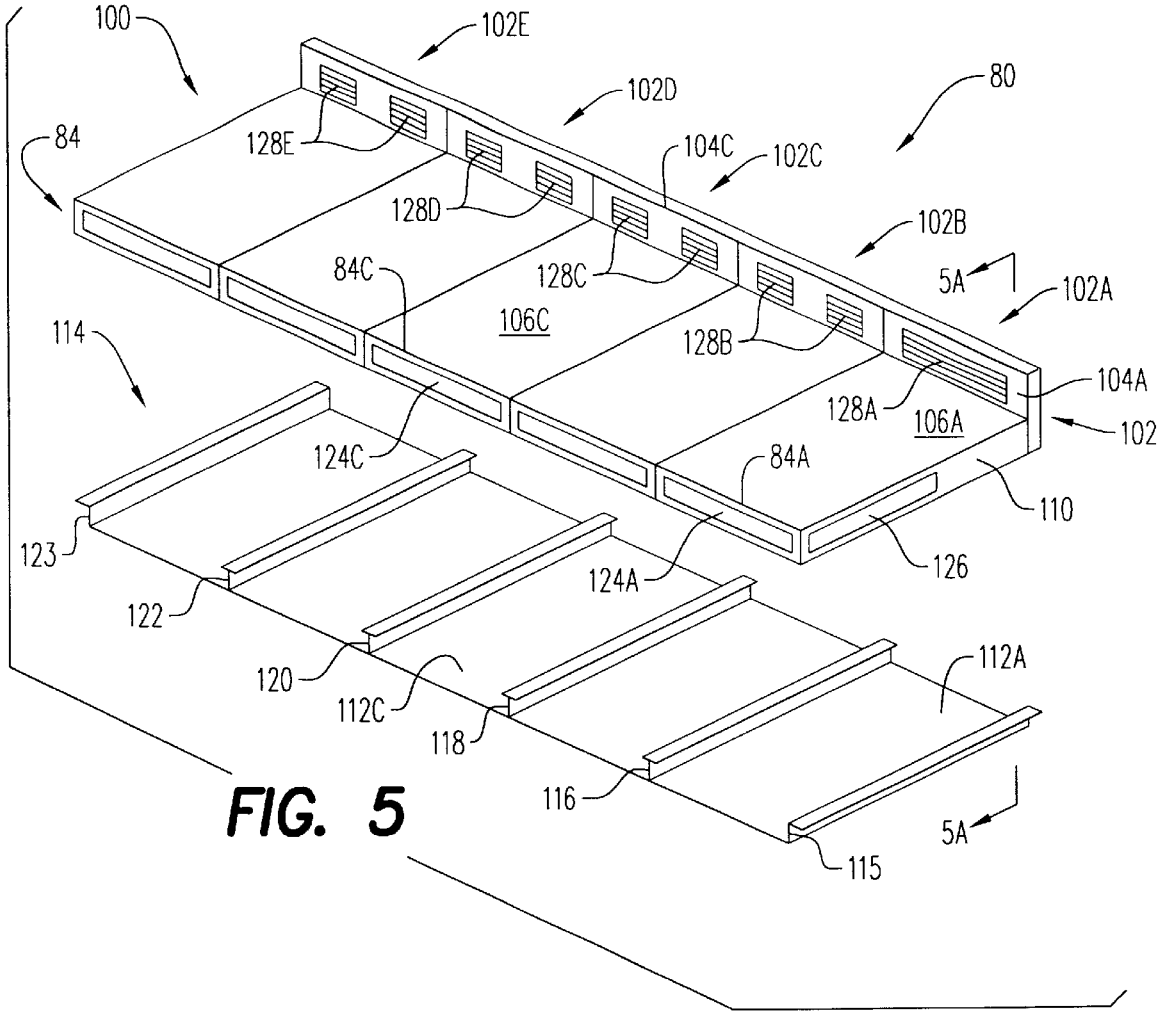
FIG. 5 is a perspective view of the food tray assembly of the self-service display of FIG. 1.

Referring to FIGS. 3 and 5, food tray assembly 80 includes a top 100, a bottom 114, front panel 84, a back splash 102, a side 110 and a back 138 (FIG. 6). Food tray assembly 80 is apportioned into separate cooling plate sections 102A–102E. Cooling plate section 102A includes a back splash 104A, a top 106A, a front 84A and a bottom 112A. Cooling plate sections 102B–102D are substantially the same. For example, cooling plate section 102C has a back splash 104C, a top 106C, a front 84C and a bottom 112C. A plurality of partitions 115, 116, 118, 120, 122 and 123 extend upwardly from bottom 114 to form a separate under tray air duct in each cooling plate section 102A–102E. Fronts 84A–84E each include apertures for the passage of cooling air. For example, fronts 84A and 84C have apertures 124A and 124C, respectively. Side 110 of cooling plate section 102A includes an aperture 126 for the passage of air.

Partitions 115, 116, 118, 120, 122 and 123 are attached to the underside of tray 100 by any suitable means, such as spot welding. As shown in FIG. 3, bottom 114 is positioned so that there is a front separation 107 between bottom 114 and front panel 84 and a back separation 109 between bottom 114 and back 32. Front separator 107 allows airflow through apertures 124A–124E and 126 to passageway 92.

Referring to FIGS. 3, 5 and 5A, end partition 115 is positioned a short distance from side 110 to allow airflow through aperture 126 into passageway 92.

Figure 8:
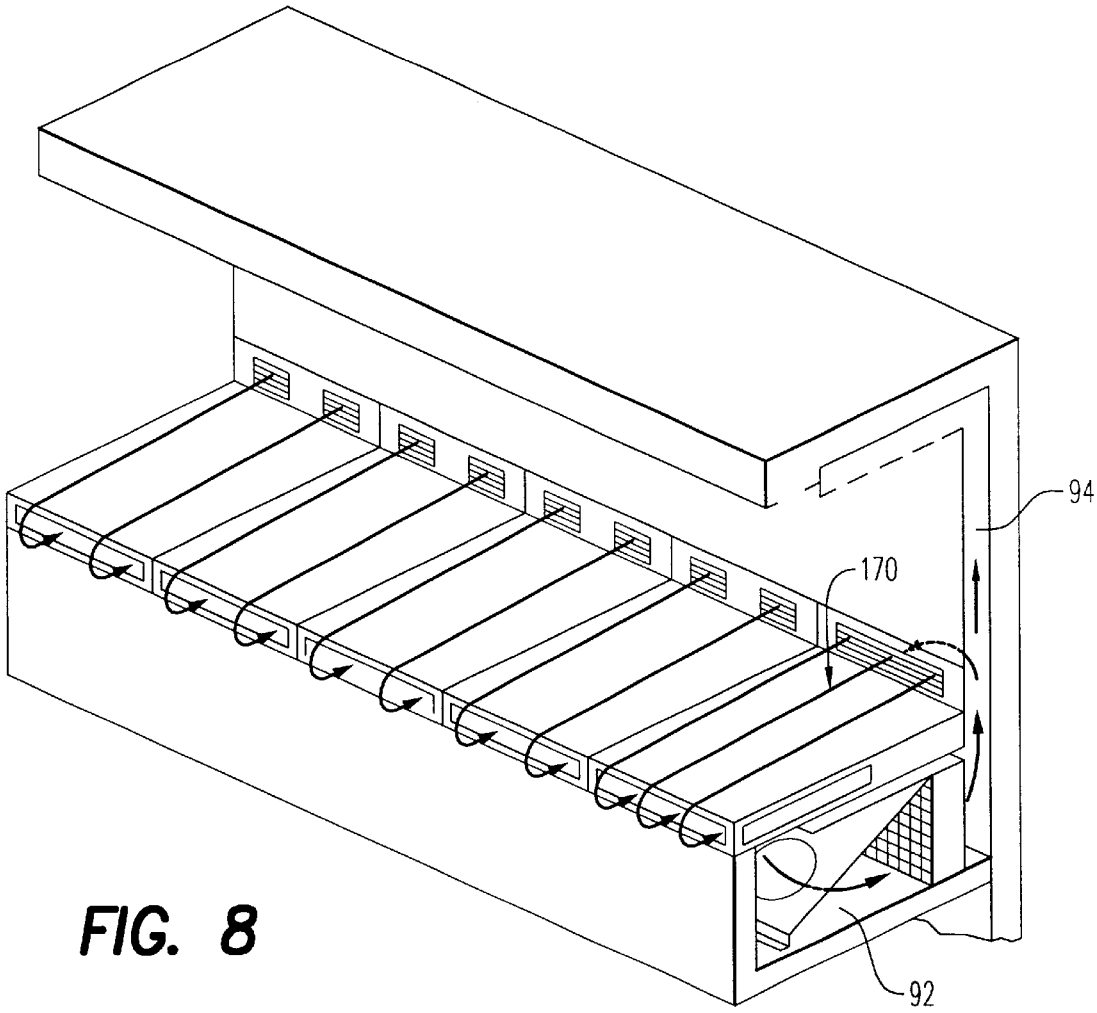
FIGS. 8–10 are perspective views of FIG. 1.

Back splashes 104A–104E have disposed therein a plurality of apertures 128A–128E, respectively. Apertures 128*a*–128E are in fluid communication with the circulating air stream to divert a portion thereof in an airflow across the top of food tray assembly 80 to gap 82 where it enters passageway 92. Aperture 128A in end cooling plate 102A is larger than the apertures in the cooling sections intermediate the opposite end of self-service food display 20. This assures a greater or larger volume of cool airflow at the ends of self-service food display 20 to minimize heat transfer from ambient. The airflow across the top of food tray assembly 80 is shown in FIG. 8 as leaving passageway 94 via apertures 128–128E, flowing across cooling plates 102A–102E, entering passageway 92 via front apertures 124A–124E to passageway 94. The higher volume airflow across end cooling plate 102A is depicted by the more concentrated arrows 170.

Referring to FIGS. 3 and 6, a blower assembly 130 includes bracket 86 to which fans 132 are mounted. Bracket 86 includes a plurality of apertures 134. Fans 132 are mounted on one side of the bracket 86 in registry with apertures 134. A plurality of filter covers are mounted in registry with apertures 134. Bracket 138 includes a vertical portion 138 that forms a back of food tray assembly 80 between bottom assembly 114 and top assembly 100. A plurality of apertures 140A–140E are disposed in vertical portion 138.

Figure 9:
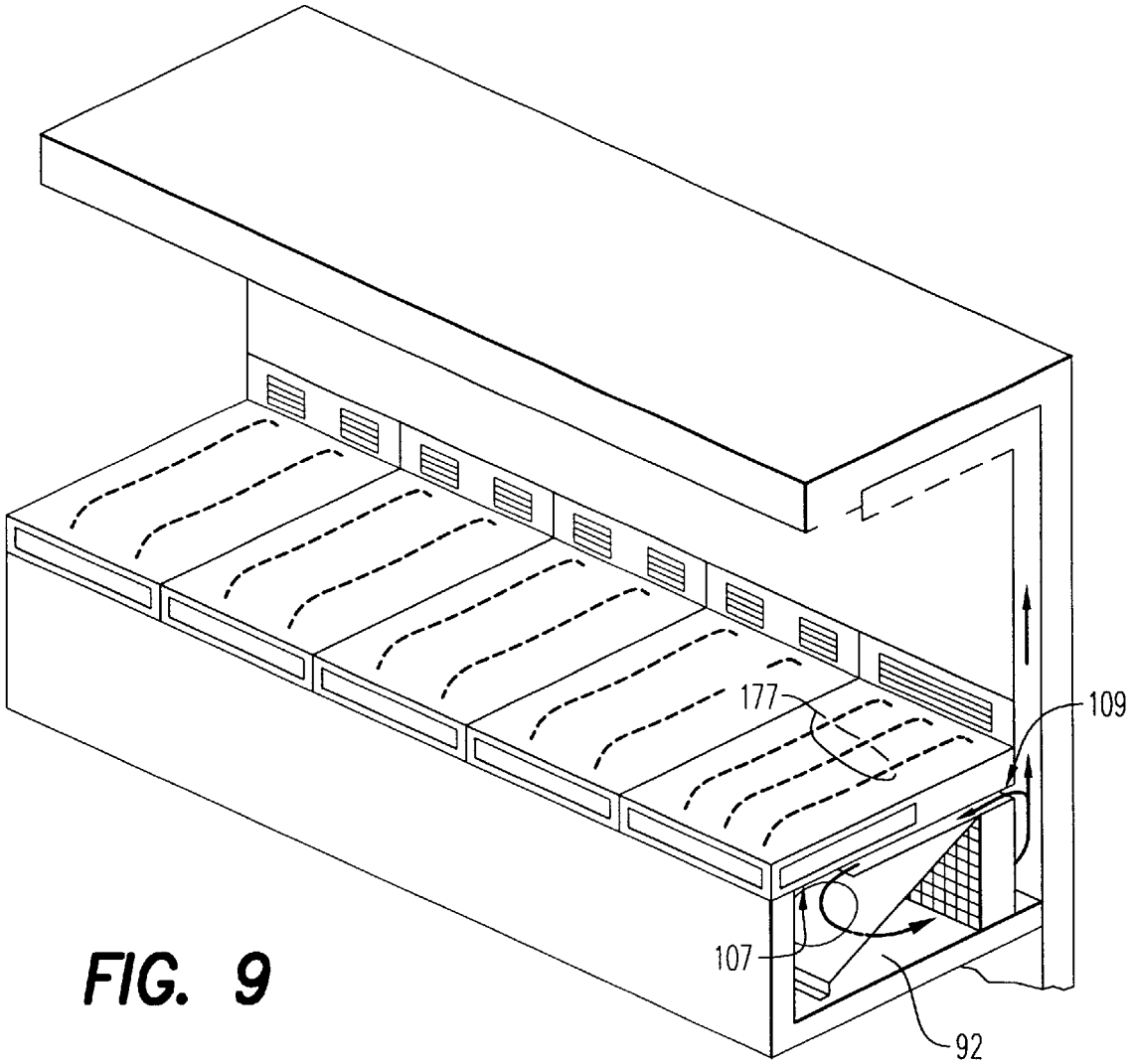

Referring to FIGS. 3, 5 and 6, a plurality of under tray ducts are provided for cooling plates 102A–102E by bottom 114 and vertical portion 138. For example, cooling plate 102A has an under tray duct 142A formed by bottom 114, partitions 115 and 116 and vertical portion 138. Under tray duct 142A is in fluid communication with the circulating air stream via front separation 107, back separation 109 and apertures 140A. Apertures 140A are greater in number than the apertures of the cooling plates intermediate the two ends of self-service food display 20. For example, cooling plate 102A has two apertures 140B vis-a-vis five apertures 140A for cooling plate 102A. This distribution of apertures allows extra cooling by the circulating air stream to compensate for heat loss at the ends of self-service food display 20. The airflow through the under tray ducts is shown in FIG. 9 by the dashed arrows in a path that includes apertures 140A–140E, front separation 107, back separation 109 and passageway 92. The more concentrated arrows 177 depict the higher volume airflow in duct 142A.

Referring to FIG. 3, shield 32 is mounted to top panel 28 and/or to passageway 96. A pivot 152 is mounted to allow shield 36 to rotate upward from the position shown to allow easy access to place food on food tray assembly 80 or to clean self-service food display 20. Passageway 96 includes an elongated air nozzle 154 that includes an array of tubes 156 arranged to form the circulating air stream into a plurality of air jets that collectively form an air curtain between nozzle 154 and apertures 124A–124E to passageways 92, 94 and 96 as shown in FIG. 9.

Figure 7:
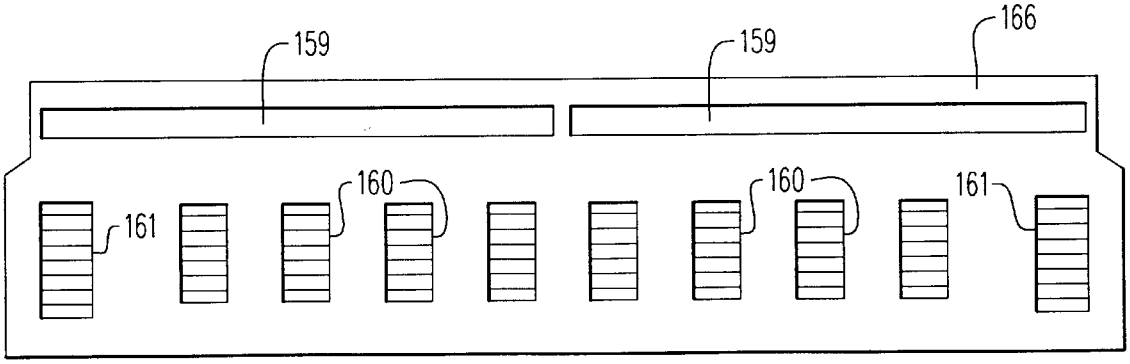
FIG. 7 is a plan view of an overhead air passageway of the self-service food display of FIG. 1.
Figure 10:
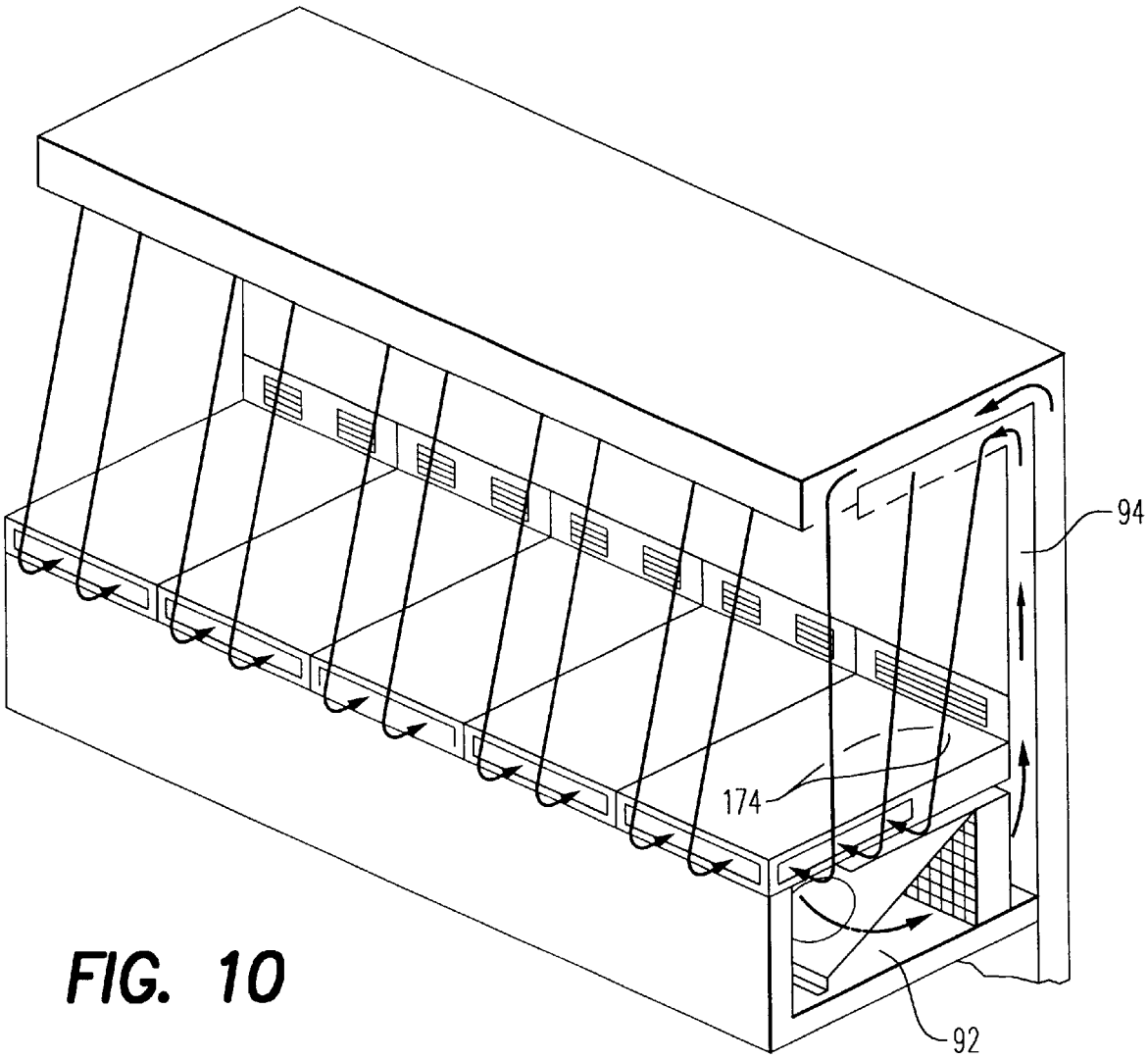

Referring to FIGS. 3 and 7, passageway 96 includes a bottom 158 in which an array of intermediate apertures 160 is disposed between a pair of end apertures 161. A plurality of baffles 162 guide air to end apertures 161 and intermediate apertures 160. End apertures 161 are larger than intermediate apertures 160 so as to provide a larger volume of air along the ends of self-service food display 20 so as to form a side air curtain to minimize heat transfer from ambient. Airflow in the side air curtain is drawn into passageway 92 via aperture 126 (FIG. 5). This side curtain airflow is shown in FIG. 10 by the side arrows 176 that flow downwardly from passageway 96.

Passageway 96 is in fluid communication with the circulating air stream via apertures 159 located in a rear wall 166 thereof. Thus, a portion of the circulating air stream is diverted into passageway 96 and distributed via apertures 159 and 60 in an airflow that is directed downwardly on food items 78, as shown by dotted arrows 164 at an acute angle to tray 100. This airflow merges with the airflow that flows from apertures 128A–128E to apertures 124A–124E.

It will be apparent to those skilled in the art that the side air curtains and/or larger air volumes over and under tray 100 can be omitted for any end section that is not exposed to ambient.

The present invention having been thus described with particular reference to the preferred forms thereof, it will be obvious that various changes and modifications may be made therein without departing from the spirit and scope of the present invention as defined in the appended claims.

What is claimed is:

1. A self-service food display comprising:

a support structure having a base, a back and a top;

a food tray having a front end, a back end and opposed side ends and supported by said support structure so as to be exposed to ambient on said front and said opposed side ends;

a ductwork extending beneath said food tray, up said back and across said top and having air curtain ports arranged therein for the formation of a front air curtain and at least one side air curtain;

means for circulating a cool air stream through said ductwork and to form said front air curtain and said at least one side air curtain; and an array of ports disposed at a location in said ductwork to provide a uniform distribution of air flow in a path that is incident to an upper surface of said food tray at an acute angle and to provide higher volumes of said air flow to said opposed ends to minimize heat transfer to ambient.

2. The self-service food display of claim 1, wherein said air flow has a uniform temperature throughout said path in the vicinity of said tray.

3. The self-service food display of claim 1, wherein said air flow in said path is incident to a substantial portion of said upper surface of said food tray.

4. A self-service food display comprising:

a support structure;

a food tray that is supported by said support structure and that has a pair of opposed side sections and one or more intermediate sections;

a ductwork that is positioned with respect to said food tray to provide a cooling air stream over and under said food tray, wherein said ductwork includes a plurality of ports arranged to distribute first volumes of said cooling air stream over and under said intermediate sections to maintain a substantially uniform temperature thereof and to distribute second volumes of said cooling air stream at least over and under said opposed end sections, and wherein each of said second volumes is larger than any of said first volumes to minimize heat transfer to ambient; and means for circulating said cool air stream through said ductwork.

5. The self-service food display of claim 4, wherein said first and second volumes of the cooling air stream flow substantially parallel to said food tray, and wherein said plurality of ports is further positioned to distribute third volumes and fourth volumes of said cooling air stream at an angle to an upper surface of said intermediate and opposed end sections, respectively.

6. The self-service food display of claim 5, wherein each of said fourth volumes is larger than any of said third volumes so as to minimize heat transfer to ambient.

7. The self-service food display of claim 4, wherein said plurality of ports is further positioned to distribute said cooling air stream in the form of air curtains extending above three sides of said food tray.

8. A method of cooling a food tray of a self-service food display, wherein said food tray has a pair of opposed end sections and one or more intermediate sections, said method comprising:

(a) providing a cooling air stream;

(b) flowing first volumes of said cooling air stream over and under said intermediate sections in a manner to provide a substantially uniform temperature in the vicinity of said food tray; and (c) flowing second volumes of said cooling air stream over said opposed end sections, wherein said second volumes are higher than any of said first volumes to minimize heat transfer to ambient.

9. The method of claim 8, further comprising:

(d) flowing said cooling air stream in a manner to provide an air curtain that extends above three sides of said food tray.

10. A method of cooling a food tray of a self-service food display, wherein said food tray has a pair of opposed end sections and one or more intermediate sections, said method comprising:

(a) providing a cooling air stream;

(b) flowing said cooling air stream over and under said intermediate sections in a manner to provide a substantially uniform temperature in the vicinity of said food tray;

(c) flowing said cooling air stream over and under said opposed end sections in a manner to minimize heat transfer to ambient: and (e) flowing said cooling air stream in a manner to provide an air flow at an acute angle to an upper surface of said food tray in a manner that provides a uniform volumes of said cooling air stream to said intermediate sections and that provides higher volumes of said cooling air stream to said opposed end sections to minimize heat transfer to ambient.

* * * * *